US006385777B1

(12) United States Patent
Hamada et al.

(10) Patent No.: US 6,385,777 B1
(45) Date of Patent: May 14, 2002

(54) CLOTHES-ADJUSTING APPARATUS

(75) Inventors: Kuniaki Hamada; Kaoru Hamada, both of Yao (JP)

(73) Assignee: Rocky Capacity Co., LTD, Osaka-Fu (JP)

( * ) Notice: Subject to any disclaimer, the term of this patent is extended or adjusted under 35 U.S.C. 154(b) by 0 days.

(21) Appl. No.: 09/430,525

(22) Filed: Oct. 29, 1999

(30) Foreign Application Priority Data

Oct. 30, 1998 (JP) ..... 9-310162

(51) Int. Cl.[7] ..... A41D 1/14
(52) U.S. Cl. ..... 2/221
(58) Field of Search ..... 2/221, 211, 220, 2/236, 237, 219, 218

(56) References Cited

U.S. PATENT DOCUMENTS 2,023,132 A * 12/1935 Goldman ..... 2/235
2,593,795 A * 6/1949 Rhoads et al. ..... 2/235
3,793,645 A * 2/1974 Kadison ..... 2/221
3,835,473 A * 9/1974 Toyoda ..... 2/237
3,839,740 A * 10/1974 Tornberg ..... 2/237
4,193,136 A * 3/1980 Pierce ..... 2/237

* cited by examiner

*Primary Examiner*—John J. Calvert
*Assistant Examiner*—James G Smith
(74) *Attorney, Agent, or Firm*—Keating & Bennett, LLP

(57) ABSTRACT

A clothes-adjusting apparatus capable of adjusting the dimension thereof in a wide range includes a second cloth member joined to a first cloth member at one edge thereof. A third cloth member is joined to the first cloth member at another edge thereof. The first, second, and third cloth members are joined to a waistband. A dimension-adjusting part is defined by overlapping a predetermined length of one end portion of the waistband on the other end thereof. A slide fastener is provided between a side of the second cloth member which is positioned opposite to the first cloth member and a side of the third cloth member which is positioned opposite to the first cloth member. The second cloth member and the third cloth member are joined to each other at a joining portion by overlapping a lower end portion of the second cloth member and that of the third cloth member on each other. A male member is sewed to a rear surface of the one end portion of the waistband, and a female member is installed on the other end portion of the waistband such that the female member is slidable on a guide belt.

9 Claims, 8 Drawing Sheets

CLOTHES-ADJUSTING APPARATUS

BACKGROUND OF THE INVENTION

1. Field of the Invention

The present invention relates to a clothes-adjusting apparatus, and more particularly, to a clothes-adjusting apparatus for adjusting the dimension of the waist of a skirt, trousers, and the like.

2. Description of the Prior Art

FIG. 8 shows an example of a conventional skirt 1. The skirt 1 includes a slide fastener 2 having teeth 2*a* and 2*b* that engage with each other to close an open portion 3. A locking member 5 is provided on a waistband of the skirt 1 at a position opposite to a fastener stop portion 4 of the slide fastener 2. The locking member 5 includes a male member 5*a* and a female member 5*b* that couple with each other when the open portion 3 is closed. To vary the circumferential dimension of the waist of the skirt 1, it is necessary to remove the male member 5*a* and the female member 5*b* from the waistband and sew them at a different position on the waistband.

With respect to conventional clothes such as a skirt 1, the installing position of the member 5 can be changed only to the extent that teeth 2*a* and 2*b* of the slide fastener 2 can still engage each other. That is, if the position of the male member 5*a* and that of the female member 5*b* are shifted too far from each other, the teeth 2*a* and 2*b* of the slide fastener 2 cannot engage. As a result, the waist size of clothing such as the skirt 1 can be adjusted only within a very narrow range.

SUMMARY OF THE INVENTION

The present invention provides a clothes-adjusting apparatus capable of easily and liberally adjusting the dimension of the waist of a clothing, such as a skirt, trousers or the like.

The clothes-adjusting apparatus according to a preferred embodiment of the present invention provides a waist band member; a dimension-adjusting part defined by overlapping one end portion of the band member over the other end portion of the band member; a first cloth member joined to the band member and extending from one end portion of the band member toward the other end portion of the band member near the dimension-adjusting part; and a second cloth member that is provided in the dimension-adjusting part having one edge joined to the other end portion of the band member and having another edge joined to the first cloth member.

When an overlapping length of the one end portion of the band member and the other end portion thereof is decreased, the first and second cloth member unfold from each other and together make up an outer surface of the clothes. On the other hand, when the overlapping length is increased to a maximum overlap, the second cloth member preferably folds behind the first cloth member and only the first cloth member defines the outer surface of the skirt. The clothes-adjusting apparatus also preferably includes a third cloth member interposed between a rear surface of the first cloth member and a front surface of the second cloth member such that one edge of the third cloth member is joined to one end portion of the band member and another edge joined to a vertical edge of the first cloth member.

The preferred embodiment also may preferably include a slide fastener provided in the dimension-adjusting part, a joining portion provided in the dimension-adjusting part by joining together the second cloth member and the third cloth member starting from a position proximate to a fastener stop portion of the slide fastener to the one edge of the first cloth member, and a locking device provided at a position opposed to the joining portion of the dimension-adjusting part such that the locking position can vary in a circumferential direction of the band member.

Many advantages are achieved by preferred embodiments of the present invention. For one, because the decrease and increase of the overlapping length of the one end portion of the band member and the other end portion thereof is absorbed by the clothes-adjusting apparatus and the first and second cloth members, the function of the slide fastener is not hindered. Accordingly, unlike the conventional clothes-adjusting apparatus, the clothes-adjusting apparatus of preferred embodiments of the present invention is capable of adjusting the circumferential length of the band member in a wide range without changing the installing position of the fastening device.

Second, because the slide fastener is not exposed to the outside, the clothes appear more attractive. When a user takes off the clothes, the user unlocks the locking devices from the band member and unzips the slide fastener to separate one end portion of the band member and the other end portion thereof from each other, resulting in a large opening. Thus, it becomes easy for the user to take on and off the clothes. When the user puts on the clothes, the user zips the slide fastener, and locks one end portion of the band member and the other end portion thereof to the locking device while wearing the clothes. Moreover, in the event the user forgets to zip the slide fastener, his or her under garment cannot be seen from the outside.

According to another embodiment of the present invention, the locking device includes a male member provided in the dimension-adjusting part and located on a rear surface of the one end portion of the band member; a guide belt formed on a surface of the band member such that the guide belt is proximate to the other end portion of the band member in the circumferential direction thereof; and a female member installed on the guide belt such that the female member is movable in a circumferential direction of the band member and engaging the male member to removably lock the one and other end portions of the band member thereto. It is possible to adjust the circumferential length of the band member by displacing the female member in the longitudinal direction of the band member. Accordingly, this preferred embodiment makes it possible to adjust the circumferential length of the band member in a wide range.

According to another preferred embodiment of the present invention, the female member includes an installing portion slidably installed on the guide belt; a concave portion for locking the male member thereto; and a hooking claw member removably locking a plurality of projections formed at predetermined intervals on the guide belt. The female member is installed on the guide belt such that it is slidable in a circumferential direction. The user can hook the hooking claw member to any one of the desired projections of the guide belt.

According to another embodiment of the present invention, the hooking claw member is pivotal in a direction in which the hooking claw member separates from the projection of the guide belt, with the hooking claw member being resistively urged that locks the projection thereto. When the user alters the locking position of the female member, the user unlocks the projection from the hooking claw member by pivoting the hooking claw member against the resistive force. The user can hook the hooking claw member to the projection securely because the hooking claw member is always resistively urged toward the projection.

According to another preferred embodiment of the present invention, the locking member includes a male member positioned in the dimension-adjusting part and provided on a rear surface of the one end portion of the band member; and a plurality of female members formed at predetermined intervals on a surface of the band member. The user can adjust the circumferential length of the band member by hooking the male member to any one of the female members provided on the band.

According to another preferred embodiment of the present invention, a pocket for accommodating a small article such as handkerchief is defined by a space surrounded by the band member, the slide fastener, and the joining portion such that the pocket is disposed between the second cloth member and the third cloth member. In this case, the dimension-adjusting part serves as a pocket, the clothes are functional, easy to use, and attractive.

According to another preferred embodiment of the present invention, a length of an open portion of the pocket is less than an entire length of the slide fastener to prevent an article from dropping from the pocket. In this preferred embodiment, the opening of the pocket is set less than the entire length of the slide fastener. Thus, an article can be prevented from dropping from the pocket unless the use takes it out intentionally.

The above and further objects, features, aspects, and advantages of the present invention will be more fully apparent from the following detailed description with the accompanying drawings.

DETAILED DESCRIPTION OF PREFERRED EMBODIMENTS

Figure 1:
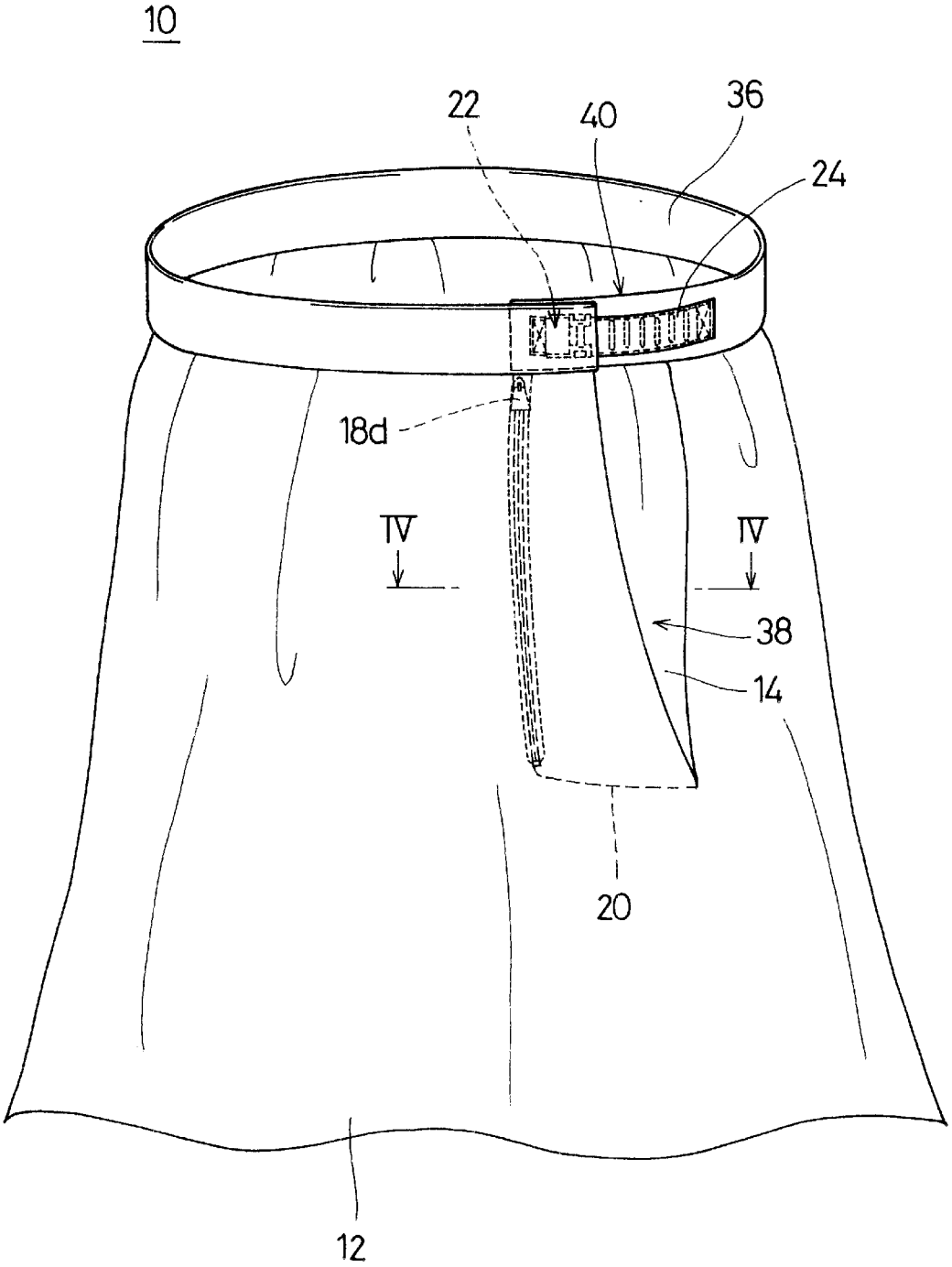
FIG. 1 is a perspective view showing a skirt as an example of clothes to which the clothes-adjusting apparatus according to the present invention is applied.
Figure 2:
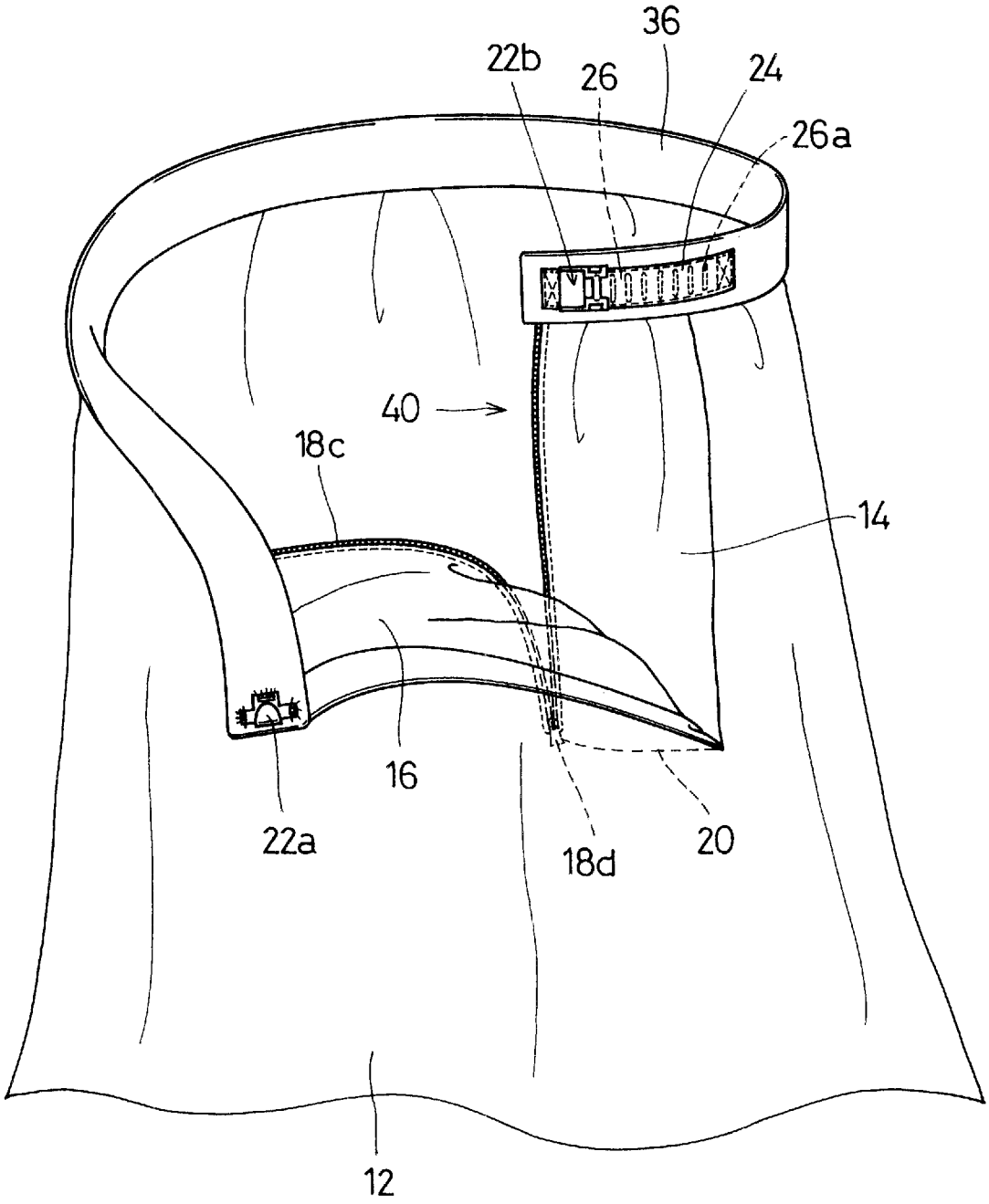
FIG. 2 is a perspective view showing a state in which a slide fastener of the clothes shown in FIG. 1 is opened.
Figure 3:
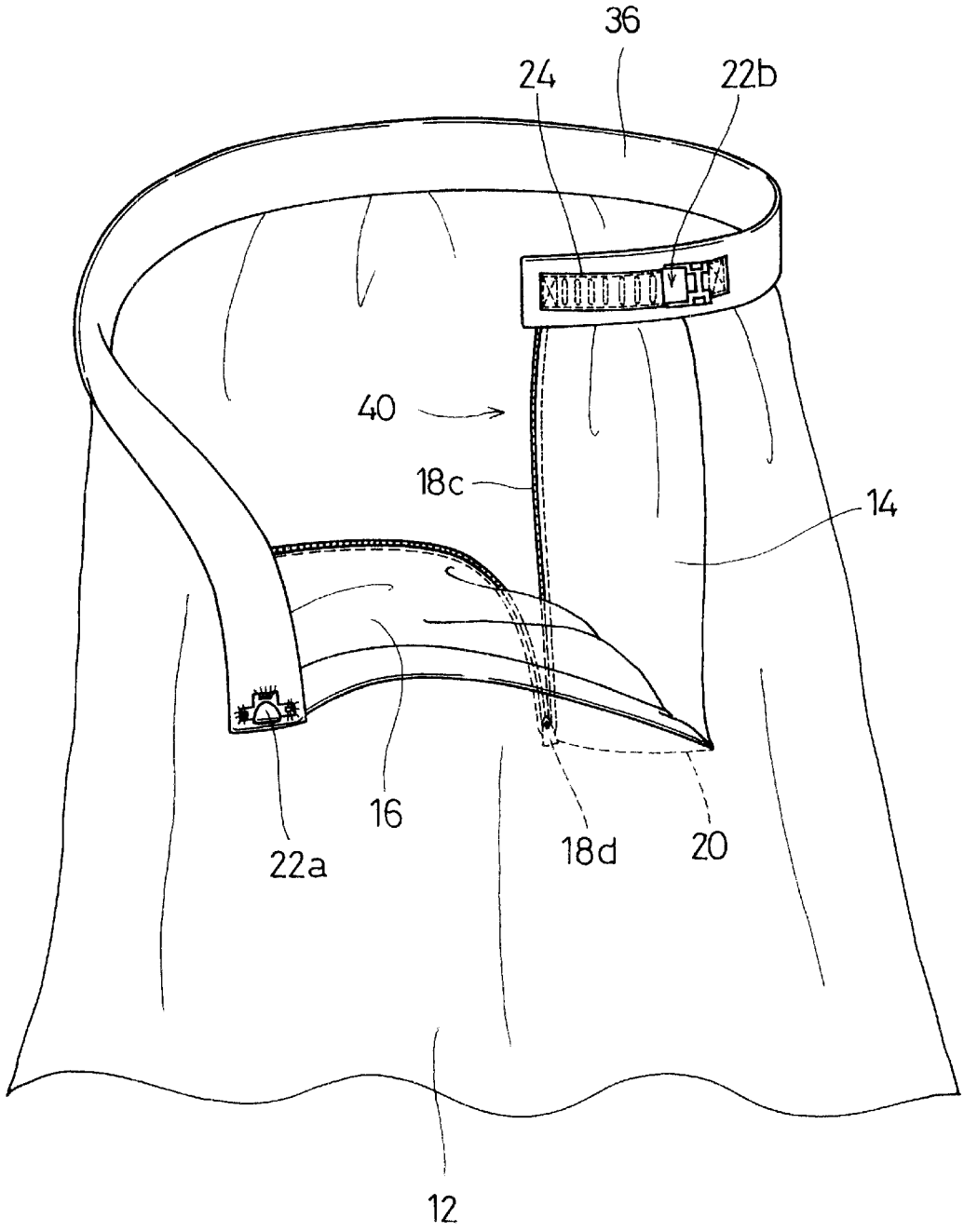
FIG. 3 is a perspective view showing a state in which a female metal fitting of a locking member of the clothes shown in FIG. 2 can be slid to change the position thereof.

FIGS. 1–3 show a preferred embodiment of a clothes-adjusting apparatus applied to a skirt 10. The skirt 10 preferably includes a first cloth member 12 constituting an outer surface of the skirt 10. A second cloth member 14 is attached to the first cloth member 12 at edge 63 in the circumferential direction of the waist. A third cloth member 16 having a shape similar to that of the second cloth member 14 is attached to the first cloth member 12 at the other edge 64 in the circumferential direction of the waist. The first, second, and third cloth members 12, 14, and 16 are attached to one edge of a long and narrow waistband 36 in the circumferential direction thereof.

A dimension-adjusting part 40 is constructed by overlapping a predetermined length of one end portion of the waistband 36 in a circumferential direction on the other end of the waistband 36. Although the first cloth member 12 is preferably constructed of one-piece cloth, the first cloth member 12 may be constructed of a plurality of connected cloths by attaching such cloths to the waistband 36 in the circumferential direction of the waist.

When the dimension-adjusting part 40 is increased or decreased to alter the dimension of the waist of the skirt 10, the second cloth member 14 and the first cloth member 12 fold or unfold to make up the outer surface of the skirt 10. Accordingly, the material of the second cloth member 14 is preferably the same as that of the first cloth member 12. Similarly to ordinary clothes, lining is preferably sewed to the rear surface of each of the first and second cloth members 12, 14. The third cloth member 16 is present on the inner side of first cloth member 12, a mesh cloth or the like having a plurality of through-holes formed therethrough is preferably used.

FIG. 4 shows a fastener tape 18*a* of the slide fastener 18 is sewed to an edge 62A. The other fastener tape 18*b* of the slide fastener 18 is sewed to an edge 62B. A tooth 18*c* is fixed to both fastener tapes 18*a* and 18*b*. Similar to an ordinary zipper, a slider 18*d* is vertically slid to engage the tooth 18*c* of the fastener tapes 18*a* and 18*b* to engage and disengage them from each other.

The second cloth member 14 and the third cloth member 16 are sewed together at a sewing portion 20 by overlapping the lower end portions thereof on each other. The sewing portion 20 is preferably arranged substantially parallel with the waistband 36, extending from a position proximate to a fastener stop portion (lower end) of the slide fastener 18 to point at which the second cloth member 14 and third cloth member 16 are connected to the first cloth member 12.

A hook-shaped male member 22*a* made of metal like material is attached to the rear surface of the one end portion of the waistband 36. A substantially rectangular guide cloth 24 extending in the circumferential direction of the waistband 36 is attached near the upper end of the second cloth member 14. More specifically, the guide cloth 24 is provided on the front surface of the other end portion of the waistband 36, opposite the male member 22*a*. As shown in FIG. 6, a guide belt 26 made of plastic or the like is sewed to the rear surface of the guide cloth 24. A plurality of linear narrow projections 26*a* vertically extending is formed on the guide belt 26 at regular intervals. A female member 22*b* is installed on the front surface of the central region of the guide cloth 24. The female member 22*b* fastens the male member 22*a* by removably hooking it to close the open portion of the skirt 10. To enlarge the waist size of skirt 10, the open portion of the skirt 10 is arranged so that it can be opened downward to about 2/3 of the whole length of the skirt 10 from the upper end line of the waistband 36. The open portion is preferably located a little forward from the left hipbone.

Figure 5:
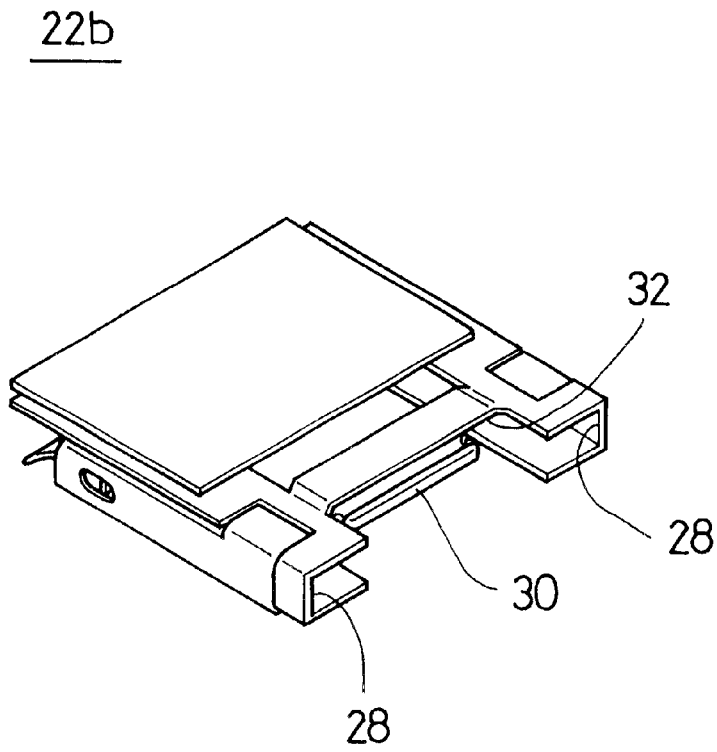
FIG. 5 is a perspective view showing the female member of the clothes-adjusting apparatus shown in FIG. 1.

FIG. 5 is a perspective view showing the female member 22*b* of the clothes-adjusting apparatus applied to the skirt 10. FIG. 6 is a sectional view illustrating the operation of the female member 22*b*. The female member 22*b* preferably has a pair of substantially U-shaped installing portions 28 that are opposed to each other on the upper and lower edges of the guide cloth 24 and the guide belt 26 such that the installing portion 28 is slidable along guide belt 26. A through-concave portion 32 for locking the male member

Figure 6A:
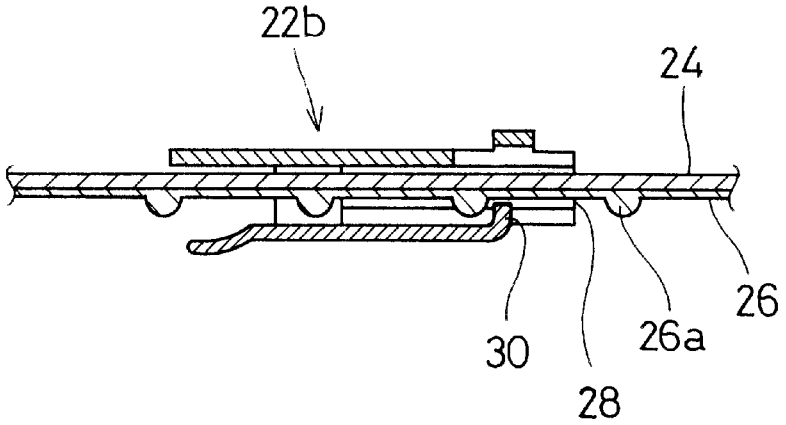
FIG. 6 is a sectional view for describing the operation situation of the female member shown in FIG. 5.

22*a* is provided on the front side of the female member 22*b*. As shown in FIG. 6A, the female member 22*b* has a hooking claw member 30 that is preferably installed on the rear side thereof. The hooking claw member 30 is oriented in a direction in which the front end locks the projection 26*a* of the guide belt 26, and such that the hooking claw member 30 is resistively pivotal against guide belt 26. The female member 22*b* cannot slide when the hooking claw member 30 is in engagement with the projection 26*a* of the guide belt 26.

Figure 4A:
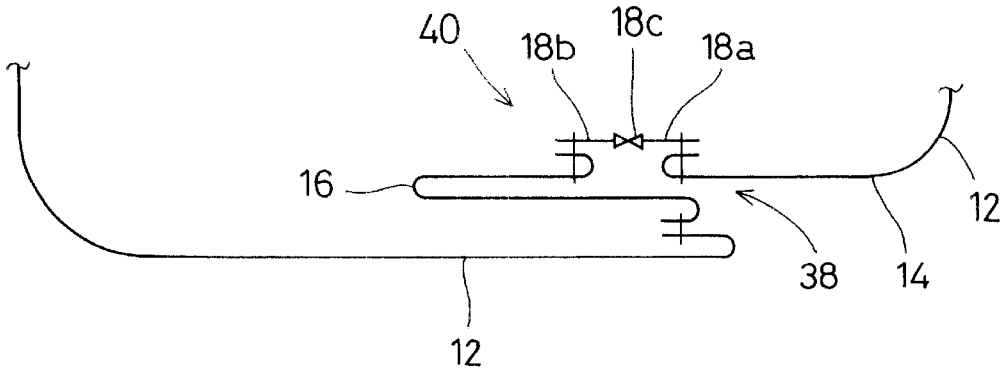
FIG. 4 is a sectional view taken along a line IV—IV of FIG. 1.
Figure 4B:
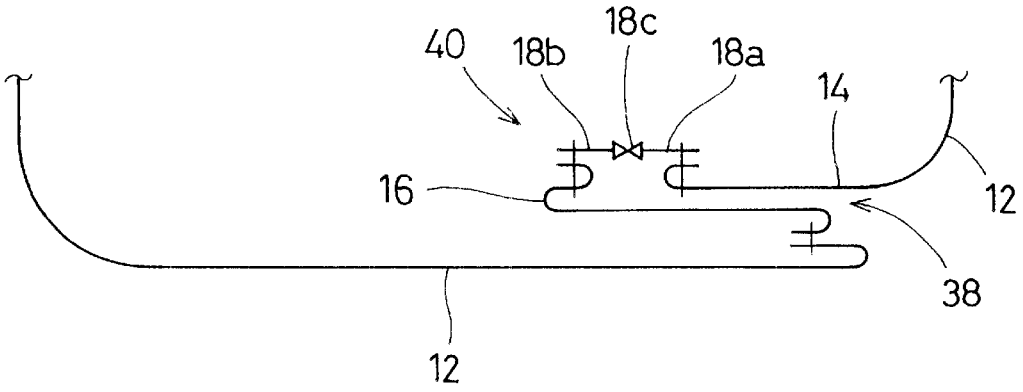
Figure 6B:
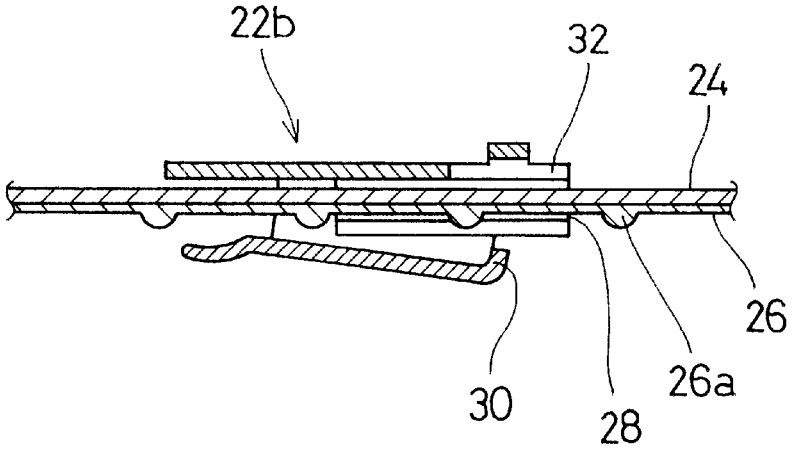

As shown in FIG. 6B, when the hooking claw member 30 is pivoted by pressing the rear end of the hooking claw member 30, the projection 26*a* is unlocked from the hooking claw member 30. Consequently, the female member 22*b* can slide. By sliding the female member 22*b* in the circumferential direction of the waistband 36, its overlapping length changes in the dimension-adjusting part 40. When the circumferential length of the waist is decreased as shown in FIG. 4B, the second cloth member 14 is folded between the first cloth member 12 and the third cloth member 16. On the other hand, when the dimension of the waist is increased, as shown in FIG. 4A, the second cloth member 14 is exposed. Because the decrease and increase of the circumferential length of the waist is absorbed by the clothes-adjusting apparatus, the function of the slide fastener 18 is not hindered. Accordingly, unlike the conventional clothes-adjusting apparatus, the clothes-adjusting apparatus of the skirt 10 is capable of adjusting the circumferential length of the waist in a wide range.

In the clothes-adjusting apparatus of the skirt 10, when the slide fastener 18 is zipped, a bag-shaped pocket 38 is defined by a space between the second cloth member 14, the third cloth member 16, and the joining portion 20. The joining portion 20 is arranged to prevent objects from dropping from the pocket 38 such that it descends from entrance of the pocket 38 to its innermost portion. It is preferable that the vertical length of the open portion of the pocket 38 is equal to or smaller than that of the slide fastener 18. In the clothes-adjusting apparatus of the skirt 10, because the slide fastener 18 is formed in the innermost portion of the pocket 38, the slide fastener 18 is not exposed to the outside. Even when the user forgets to zip the slide fastener 18, underwear cannot be seen from the outside because the slide fastener 18 is formed in the innermost portion of the pocket 38 and is covered by the first cloth member 12.

FIGS. 2 and 3 both show maximum displacement positions of the female member 22*b* of the clothes-adjusting apparatus of the skirt 10. The female member 22*b* can lock the projection 26*a* at any desired position between the maximum displacement positions. Thus, the waist length-adjustable stage can be appropriately set by altering the number of the projections 26*a* of the guide belt 26 as well as the interval between the adjacent projections 26*a*.

Figure 7:
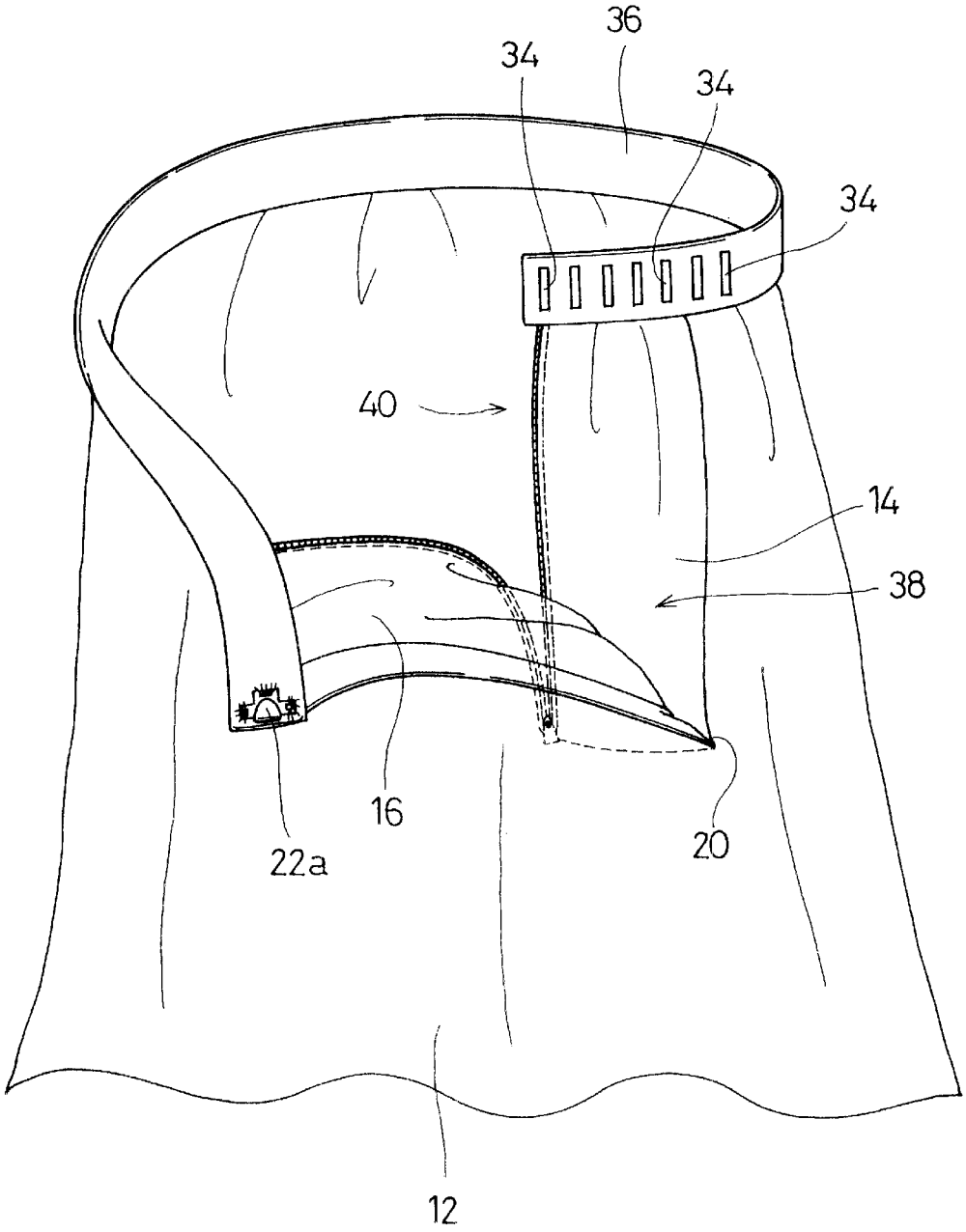
FIG. 7 is a perspective view showing a modification of the clothes-adjusting apparatus shown in FIG. 1.
Figure 8:
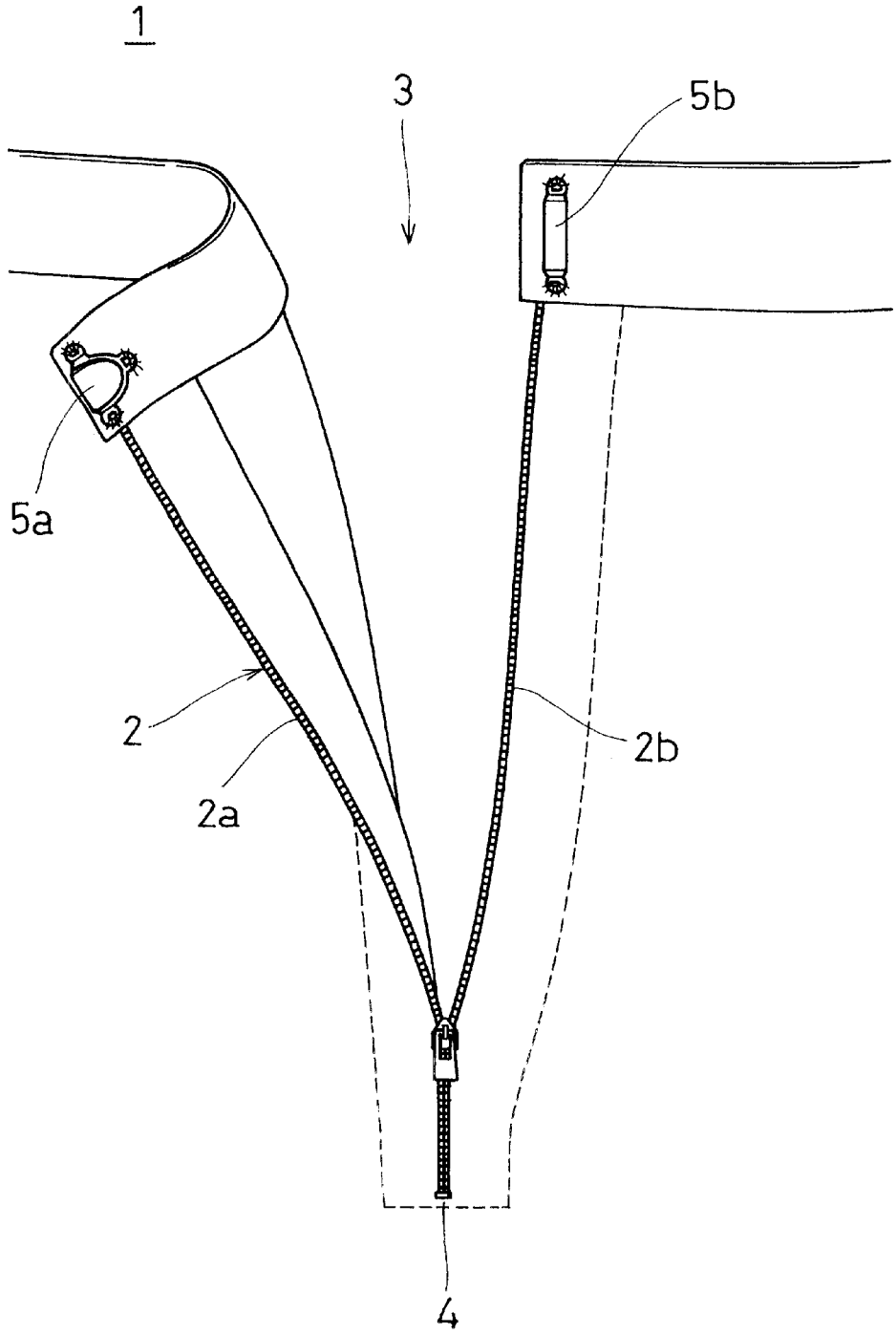
FIG. 8 shows an example of a skirt with a conventional fastener.

FIG. 7 is a perspective view showing an alternative preferred embodiment of clothes-adjusting apparatus of the skirt 10 shown in FIG. 1.

The skirt 10 shown in FIG. 7 is different from that shown in FIG. 1 in that the skirt 10 in FIG. 7 is not provided with a guide cloth or a guide belt, and has a plurality of substantially U-shaped female members 34 spaced at regular intervals and attached to the waistband 36. The circumferential length of the waist can be adjusted in a wide range by hooking the male member 22*a* to the female member 34 at a desired position.

The clothes-adjusting apparatus of the present invention can also be used to adjust the circumferential dimension of waists as well as lower ends of slacks, pants, trousers, and the like. The clothes-adjusting apparatus may also be used to adjust the circumferential length of the sleeve of an upper garment and the waist thereof, the peripheral length of the wrist of gloves, and the like.

It will be apparent from the foregoing that, while the invention has been described in detail and illustrated, there are only particular illustrations and examples and the invention is not limited to these, the spirit and scope of the invention is limited only by the appended claims.

What is claimed is:

1. A clothes-adjusting apparatus comprising:

a band member;

a dimension-adjusting part provided on said band member;

a first cloth member joined to said band member;

a second cloth member having a first edge joined to said band member and having a second edge joined to a first edge of said first cloth member;

a third cloth member interposed between a rear surface of said first cloth member and a front surface of said second cloth member, wherein a first edge of said third cloth member is joined to said band member and a second edge of said third cloth member is joined to a second edge of said first cloth member;

a fastener joined to a third edge of said second cloth member and also joined to a third edge of said third cloth member;

a joining portion formed in said dimension-adjusting part by joining a fourth edge of said second cloth member and a fourth edge of said third cloth member to each other, wherein said joining portion extends from a position near to a lower end portion of said fastener to the first edge of said first cloth member; and a locking device provided on said band member such that a locking position of said locking device is variable in a circumferential direction of said band member, said locking device removably engaging one end portion of said band member and the other end portion thereof.

2. A clothes-adjusting apparatus according to claim 1, wherein said locking device comprises:

a male locking member attached to an end portion of said band member;

a guide belt attached to another end portion of said band member; and a female locking member installed on said guide belt.

3. A clothing-adjusting apparatus according to claim 2, wherein said female locking member is slidable along said guide belt.

4. A clothes-adjusting apparatus according to claim 2, wherein said female member includes:

an installing portion slidably installed on said guide belt;

a through-concave portion for engaging said male member thereto; and a hooking claw member removably engaging a protrusion formed on said guide belt.

5. A clothes-adjusting apparatus according to claim 4, wherein said hooking claw member is pivotal in a direction in which said hooking claw member separates from said projection of said guide belt, with said hooking claw member being resistively urged in a direction in which said hooking claw member engages said projection thereto.

6. A clothes-adjusting apparatus according to claim 1, wherein said locking device includes:

a male member formed on a rear surface of said one end portion of said band member in the longitudinal direction thereof; and a plurality of female members formed on said band member.

7. A clothes-adjusting apparatus according to claims 1, further comprising a pocket that is bound by said band member, said slide fastener, and said sewing portion so that said pocket is disposed between said second cloth member and said third cloth member.

8. A clothes-adjusting apparatus according to claim 7, wherein an open portion of said pocket is shorter in distance than the length of said slide fastener.

9. A skirt comprising:

a waist band member;

a dimension-adjusting part provided on said waist band member;

a first cloth member joined to said waist band member;

a second cloth member having a first edge attached to said waist band member and having a second edge joined to a first edge of said first cloth member;

a third cloth member interposed between a rear surface of said first cloth member and a front surface of said second cloth member, wherein a first edge of said third cloth member is attached to said waist band member and a second edge of said third cloth member is sewed to a second edge of said first cloth member;

a fastener attached to a third edge of said second cloth member and also joined to a third edge of said third cloth member;

a sewing portion defined by sewing together a fourth edge of said second cloth member and a fourth edge of said third cloth member, wherein said sewing portion extends from a position near to a lower end portion of said fastener to the first edge of said first cloth member; and a locking device provided on said waist band member such that a locking position of said locking device is variable in a circumferential direction of said waist band member, said locking device removably engaging one end portion of said waist band member and the other end portion thereof.

* * * * *